US011174705B2

(12) United States Patent
Coates et al.

(10) Patent No.: US 11,174,705 B2
(45) Date of Patent: Nov. 16, 2021

(54) TUBING TESTER VALVE AND ASSOCIATED METHODS

(71) Applicant: WEATHERFORD TECHNOLOGY HOLDINGS, LLC, Houston, TX (US)

(72) Inventors: Iain D. Coates, Aberdeen (GB); Mark K. Presslie, Aberdeen (GB); Paul Day, Aberdeen (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/398,660

(22) Filed: Apr. 30, 2019

(65) Prior Publication Data

US 2020/0347699 A1 Nov. 5, 2020

(51) Int. Cl.
*E21B 34/14* (2006.01)
*E21B 47/117* (2012.01)
(Continued)

(52) U.S. Cl.
CPC ..... *E21B 34/14* (2013.01); *E21B 34/16* (2013.01); *E21B 47/06* (2013.01); *E21B 47/117* (2020.05); *E21B 47/13* (2020.05); *E21B 2200/05* (2020.05)

(58) Field of Classification Search
CPC ..... E21B 34/14; E21B 34/16; E21B 47/13; E21B 47/117; E21B 47/06; E21B 33/00; E21B 2200/05
See application file for complete search history.

(56) References Cited

U.S. PATENT DOCUMENTS 4,367,794 A * 1/1983 Bednar ..... E21B 33/127 166/66.5
5,857,523 A * 1/1999 Edwards ..... E21B 34/066 166/374
(Continued)

FOREIGN PATENT DOCUMENTS

EP 2098682 A2 9/2009
GB 2372770 A 9/2002
(Continued)

OTHER PUBLICATIONS

Weatherford; "Jetstream RFID Circulation Sub", Drilling Services article No. 10762.03, dated 2015-2016, 8 pages.
(Continued)

*Primary Examiner* — David Carroll
(74) *Attorney, Agent, or Firm* — Smith IP Services, P.C.

(57) ABSTRACT

A valve assembly can include a flow passage extending between an uphole end and a downhole end of the valve assembly, a flapper that pivots between an open position and a closed position, and a pump operable to pivot the flapper, the pump being positioned between the flapper and the downhole end. A method of testing a completion tubing string can include increasing pressure in the completion tubing string while a closure member of a valve assembly is in a closed position, thereby testing a pressure integrity of the completion tubing string on an uphole side of the closure member, and transmitting a pressure signal via a flow passage to a pressure sensor of the valve assembly, thereby causing the closure member to displace to an open position, the pressure sensor being connected to an electronic circuit positioned on a downhole side of the closure member.

18 Claims, 11 Drawing Sheets

(51) Int. Cl.

| | |
|---|---|
| ***E21B 47/13*** | (2012.01) |
| ***E21B 34/16*** | (2006.01) |
| ***E21B 47/06*** | (2012.01) |

(56) References Cited

U.S. PATENT DOCUMENTS

| | | | | |
|---|---|---|---|---|
| 6,328,109 | B1 * | 12/2001 | Pringle | E21B 23/006 166/373 |
| 6,536,524 | B1 | 3/2003 | Snider | |
| 9,115,573 | B2 | 8/2015 | Purkis et al. | |
| 2002/0108747 | A1 * | 8/2002 | Dietz | E21B 34/066 166/66.7 |
| 2002/0121373 | A1 * | 9/2002 | Patel | E21B 47/117 166/250.08 |
| 2004/0256113 | A1 * | 12/2004 | LoGiudice | E21B 34/066 166/381 |
| 2010/0025045 | A1 * | 2/2010 | Lake | E21B 34/066 166/373 |
| 2012/0067594 | A1 * | 3/2012 | Noske | E21B 34/14 166/373 |
| 2014/0306853 | A1 | 10/2014 | Purkis et al. | |

FOREIGN PATENT DOCUMENTS

| | | | |
|---|---|---|---|
| WO | 2009005017 | A2 | 4/2009 |
| WO | 2018215747 | A1 | 11/2018 |

OTHER PUBLICATIONS

Weatherford; "RFID-Enabled Tools", Completions article No. 12650.01, dated 2018, 12 pages.

Weatherford; "RFID Inflow Control Device", Well Completions article No. 12905.00, dated 2018, 2 pages.

Weatherford; "RFID Optibarrier Ball Valve", Well Completions No. 12906.00, dated 2018, 2 pages.

Weatherford; "RFID Reservoir Isolation Valve", Well Completions article No. 12908.00, dated 2018, 2 pages.

International Search Report with Written Opinion dated Aug. 4, 2020 for PCT Patent Application No. PCT/US2020/030622, 12 pages.

* cited by examiner

TUBING TESTER VALVE AND ASSOCIATED METHODS

BACKGROUND

This disclosure relates generally to equipment utilized and operations performed in conjunction with a subterranean well and, in an example described below, more particularly provides a valve assembly suitable for use in testing a pressure integrity of a tubing string in a well.

In relatively deep wells, it can be difficult to properly and economically pressure test a tubular string, such as a completion tubing string. Intervention into the well (for example, to set a plug in the tubular string) requires substantial time and expense. Although remotely operable testing valves are commercially available, components thereof generally cannot be subjected to the high absolute pressures required for pressure testing in relatively deep wells.

Therefore, it will be readily appreciated that improvements are continually needed in the arts of constructing and operating valves for use in testing a pressure integrity of a tubing string in a well. Such improvements could be useful, even in wells that are not relatively deep, and in operations other than testing the pressure integrity of a tubing string.

DETAILED DESCRIPTION

Figure 1:
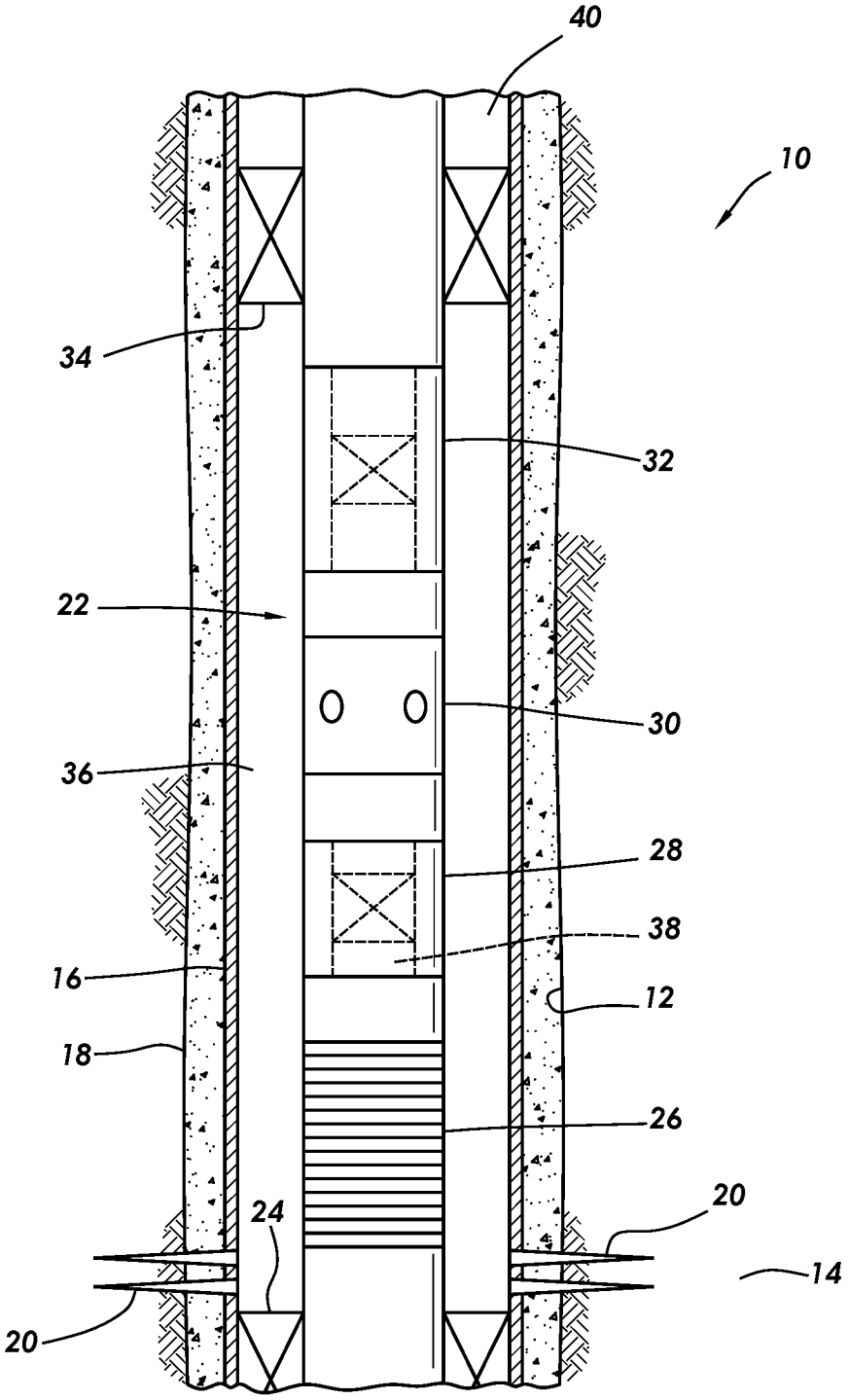
FIG. 1 is a representative partially cross-sectional view of an example of a well system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled into an earth formation 14. The wellbore 12 is lined with casing 16 and cement 18. Perforations 20 are formed through the casing 16 and cement 18 to permit fluid communication between the formation 14 and an interior of the casing 16.

As depicted in FIG. 1, the wellbore 12 is generally vertical. However, in other examples, sections of the wellbore could be generally horizontal or otherwise inclined from vertical. It also is not necessary for the wellbore 12 to be completely cased or for the perforations 20 to be used to provide fluid communication with the formation 14 (for example, the well could be completed open hole). Thus, the scope of this disclosure is not limited to any particular configuration or orientation of the wellbore 12.

Although in FIG. 1 only one zone of the formation 14 is illustrated, multiple zones of the formation 14 (or multiple formations) may be completed in other examples. The scope of this disclosure is not limited to any number, configuration or arrangement of zones to be completed.

In the FIG. 1 example, a completion tubing string 22 is installed in the well in a single trip into the wellbore 12. The completion tubing string 22 depicted in FIG. 1 includes a zonal isolation packer 24, a production screen 26, a zonal isolation valve 28, a sliding sleeve valve 30, a tubing tester valve 32 and a production packer 34. These components are especially suited for use in producing fluids from the formation 14 to surface but, in other examples, components suitable for use in injecting fluids into the formation may be used instead.

The completion tubing string 22 could include additional components, different components or fewer components. The scope of this disclosure is not limited to any particular number, arrangement or configuration of components in the completion tubing string 22.

The packer 24 serves to isolate the formation 14 zone depicted in FIG. 1 from any other zones further downhole. As understood by those skilled in the art, a "downhole" direction is a direction away from a surface of the well (such as, at the earth's surface or a sea floor) along a wellbore. Thus, if the wellbore is generally vertical (as depicted in FIG. 1), the downhole direction is a downward direction. However, if the wellbore is generally horizontal, the downhole direction is deeper along the wellbore (a greater measured distance from the surface), but is not necessarily a downward direction.

Conversely, an "uphole" direction as that term is understood by those skilled in the art is a direction toward the surface along the wellbore. Thus, if the wellbore is generally vertical (as depicted in FIG. 1), the uphole direction is an upward direction. If the wellbore is generally horizontal, the uphole direction is shallower along the wellbore (a lesser measured distance from the surface).

The packer 24 seals off an annulus 36 formed radially between the tubing string 22 and the casing 16 (or the wellbore 12 if it is uncased). The packer 24 could be a swellable, inflatable, pressure-set, mechanically-set or other type of packer. The scope of this disclosure is not limited to use of any particular type of zonal isolation packer, or to use of a zonal isolation packer at all.

The screen 26 filters sand, fines, debris or other undesired particulate matter from the fluid produced from the formation 14. In the FIG. 1 example, the fluid passes through the screen 26 when it flows from the annulus 36 into an interior flow passage 38 of the tubing string 22. The screen 26 could be a wire-wrapped, sintered, wire mesh, perforated, slotted or other type of screen. The scope of this disclosure is not limited to use of any particular type of screen, or to use of a screen at all.

The isolation valve 28 selectively controls flow through the flow passage 38. In this example, the isolation valve 28 is remotely operable using pressure signals from the surface and/or radio frequency identification (RFID) "tags" displaced through the flow passage 38. A suitable isolation valve for use as the isolation valve 28 in the FIG. 1 system is the RFID OPTIBARRIER™ Ball Valve marketed by Weatherford International, Ltd. of Houston, Tex. USA. However, the scope of this disclosure is not limited to use of any particular type of zonal isolation valve, or to use of a zonal isolation valve at all.

The sliding sleeve valve 30 selectively controls fluid communication between the annulus 36 and the flow passage 38. The valve 30 may be actuated in any manner, such as, mechanically, electrically, hydraulically, etc., and either locally or remotely. The scope of this disclosure is not limited to use of any particular type of valve to control fluid communication between the annulus 36 and the flow passage 38, or to use of such a valve at all.

The packer 34 isolates the annulus 36 from an upper annulus 40 extending to the surface, and formed radially between the completion tubing string 22 and the casing 16. The packer 34 would typically be pressure-set, but mechanically-set or other types of packers may be used in other examples. The scope of this disclosure is not limited to use of any particular type of packer.

The tubing tester valve 32 selectively controls fluid communication through the flow passage 38. Similar in some respects to the isolation valve 28, the tester valve 32 can be remotely operated by pressure signals transmitted from the surface, or by RFID tags displaced through the flow passage 38. However, as described more fully below, the tester valve 32 is specially configured, so that it is uniquely capable of use in tubing pressure tests, especially (although not exclusively) in very deep wells.

In the FIG. 1 example, the tubing tester valve 32 is connected between the packer 34 and the valve 30. This allows the pressure integrity of the tubing string 22 to be tested (for example, by applying an increased pressure to the flow passage 38 from the surface when the valve 32 is closed) above or uphole from the valve 32. In addition, if the packer 34 is a pressure-set packer, the valve 32 could be closed to permit setting the packer after the tubing string 22 is deployed into the well.

In other examples, the tubing tester valve 32 could be positioned in another location in the tubing string 22. It is not necessary for the valve 32 to be positioned below the packer 34, or between the packer 34 and the sliding sleeve valve 30. Thus, the scope of this disclosure is not limited to any particular position of the valve 32 in the tubing string 22, or to its position relative to any other component of the tubing string.

Referring additionally now to FIGS. 2A-F, a cross-sectional view of a more detailed example of a tubing tester valve assembly 50 is representatively illustrated. The tubing tester valve assembly 50 may be used for the valve 32 in the FIG. 1 system 10 and method. For convenience, the valve assembly 50 is described below as it may be used in the FIG. 1 system 10 and method, but it should be clearly understood that the valve assembly 50 may be used in other systems and methods, in keeping with the principles of this disclosure.

In the FIGS. 2A-F example, the valve assembly 50 includes a generally tubular outer housing assembly 52 having an uphole end 54 and a downhole end 56, with the flow passage 38 extending longitudinally between the uphole and downhole ends. The uphole and downhole ends 54, 56 may be provided with threaded connections 58, 60 (e.g., internally threaded at the uphole end and externally threaded at the downhole end) for sealingly connecting the valve assembly 50 in the tubular string 22.

Figure 2A:
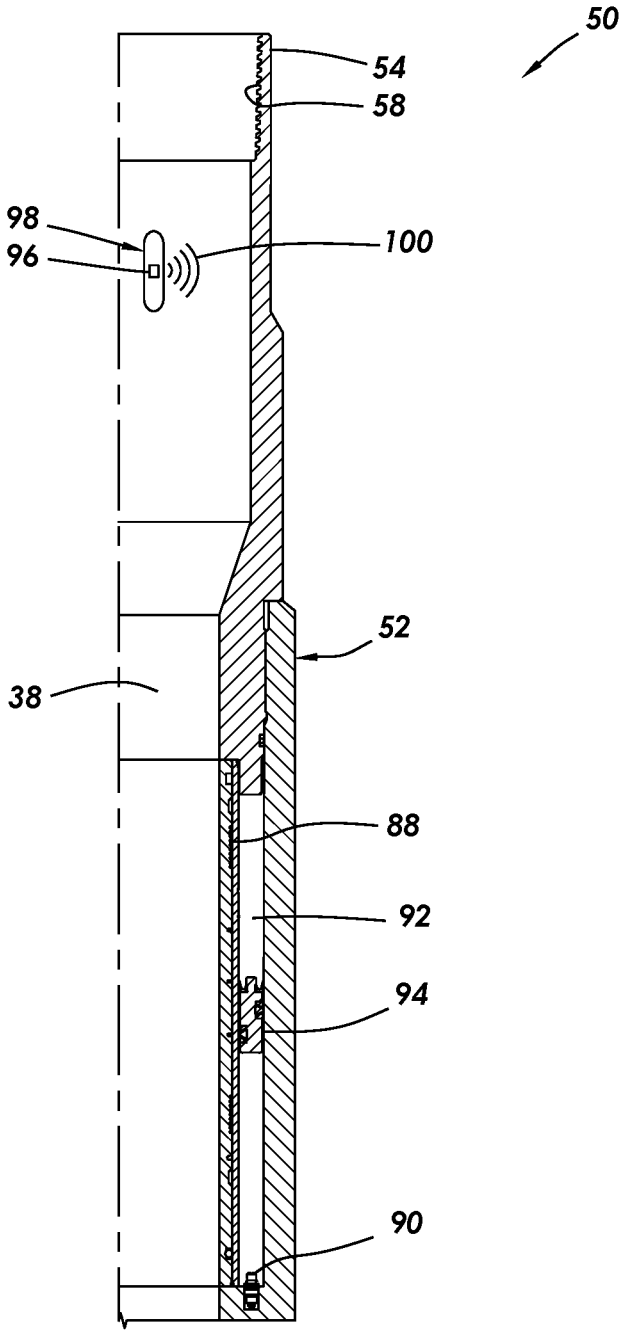
FIGS. 2A-F are representative cross-sectional views of successive axial sections of an example of a valve assembly that may be used in the system and method of FIG. 1, and which can embody the principles of this disclosure, the valve assembly being in an open configuration.
Figure 2B:
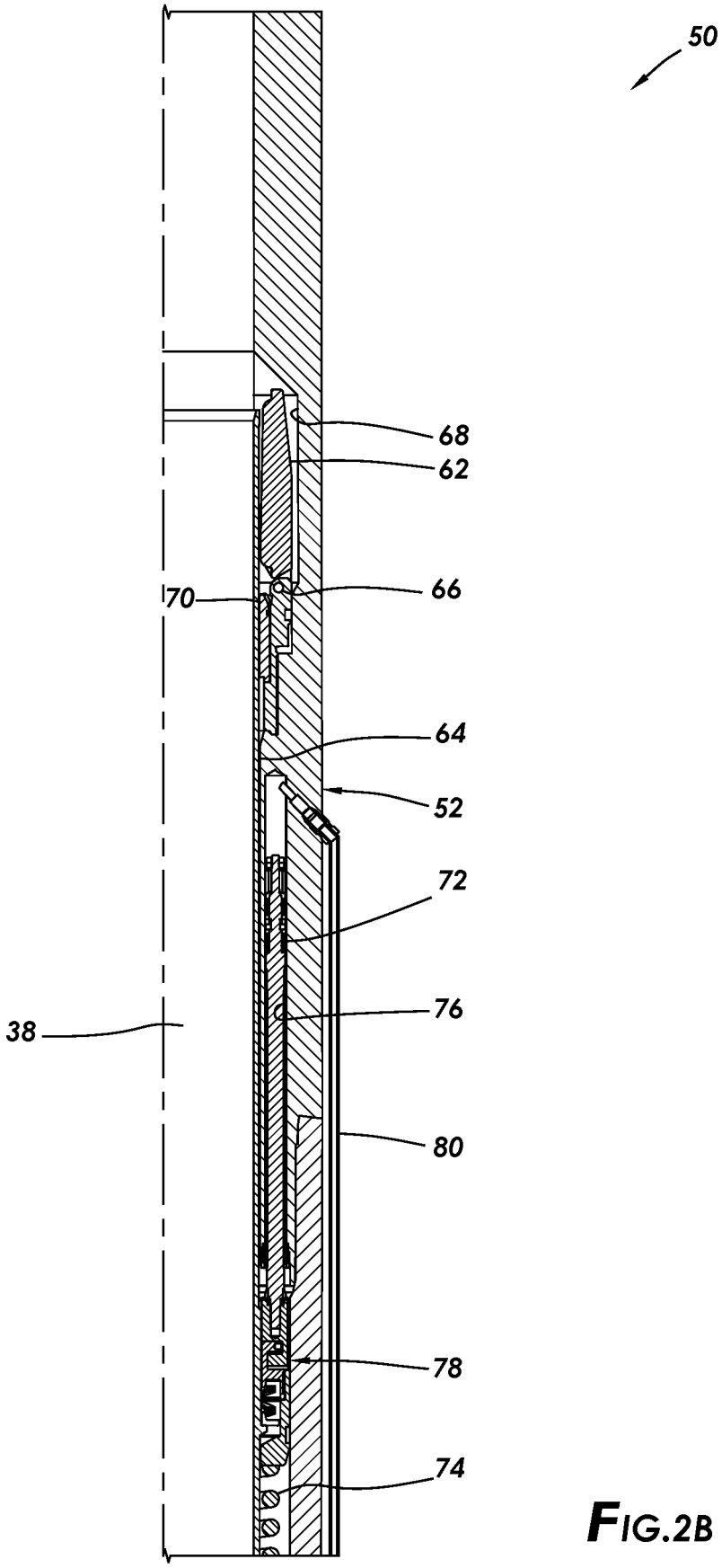
Figure 2C:
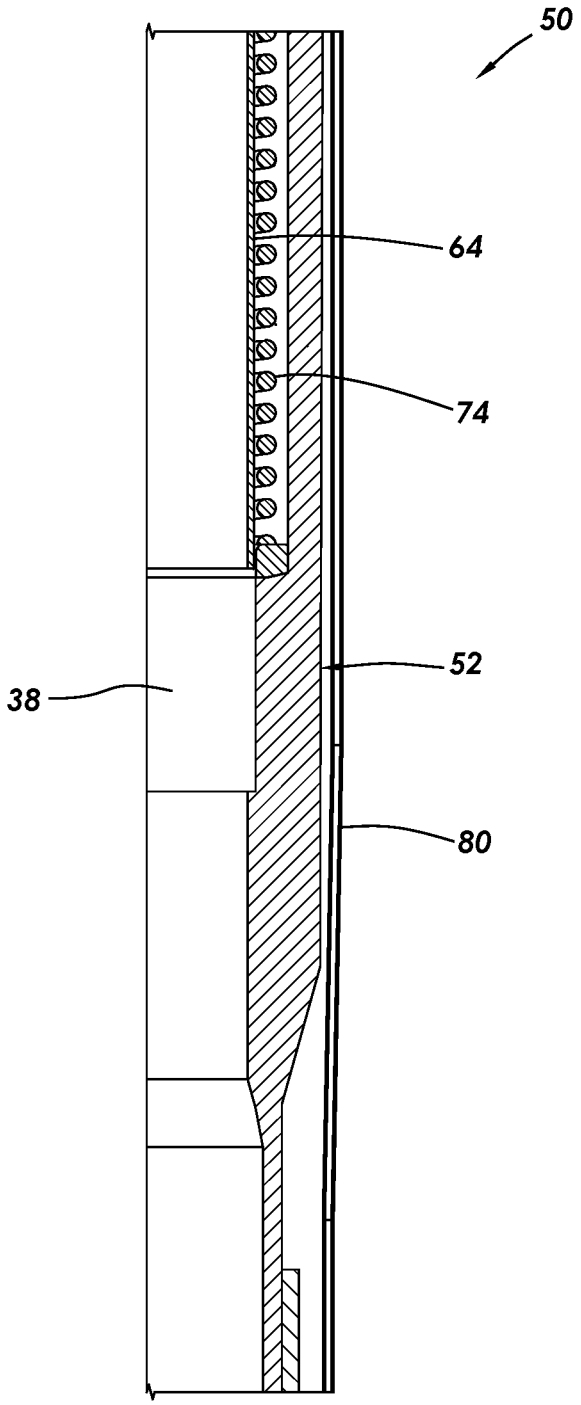

As depicted in FIG. 2B, the valve assembly 50 includes a closure member 62 for preventing fluid flow through the flow passage 38. The closure member 62 is in an open position in FIG. 2B, and is maintained in this position by a sleeve 64 that is reciprocably disposed in the housing assembly 52, so that the flow passage 38 extends longitudinally through the sleeve.

In this example, the closure member 62 is in the form of a flapper that is rotatable about a pivot 66 relative to the flow passage 38 and the housing assembly 52. The flapper is received in a recess 68 formed in the housing assembly 52. In the FIG. 2B open position, the flapper is rotated upward toward the uphole end 54 of the valve assembly 50. Instead of a flapper, the closure member 62 could in other examples include another type of closure member.

When the flapper is in its closed position, as described more fully below, the flapper is rotated downward toward the downhole end 56, so that it can sealingly engage a seat 70 that encircles the flow passage 38. The sleeve 64 is displaced downward toward the downhole end 56, in order to allow the flapper to rotate toward the downhole end 56 and eventually engage the seat 70.

Displacement of the sleeve 64 is achieved by means of a piston 72 and a spring 74. The piston 72 is sealingly and reciprocably received in a bore 76 formed in the housing assembly 52. A connector 78 secures the piston and sleeve to each other, so that they displace together relative to the housing assembly 52. The spring 74 applies an upwardly directed biasing force to the connector 78.

An upper piston area of the piston 72 is exposed to pressure in the bore 76 above the piston, and a lower piston area of the piston is exposed to pressure in the bore below the piston. The bore 76 above the piston 72 is in fluid communication with an outer control line 80, and the bore below the piston is in fluid communication with the flow passage 38. Thus, a pressure differential across the piston 72 is equal to a difference in pressure between the control line 80 and the flow passage 38.

When the pressure differential from above to below the piston 72 is greater than the upward biasing force exerted by the spring 74, the piston 72 will displace downward toward the downhole end 56. This downward displacement of the piston 72 will also cause the sleeve 64 to displace downward, and will cause the spring 74 to be longitudinally compressed.

Figure 2D:
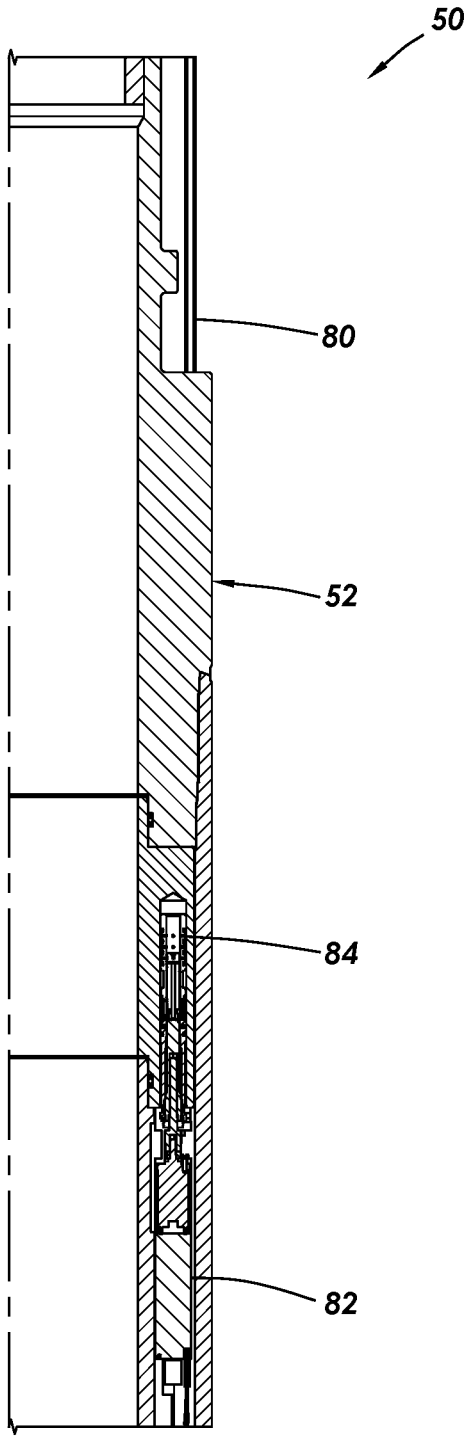

Increased pressure can be applied to the control line 80 by operation of a pump 82 (see FIG. 2D). A control valve 84 provides selective fluid communication between an output of the pump 82 and an interior of the control line 80. The control valve 84 can vent pressure in the control line 80, when desired, so that the spring 74 can displace the piston 72 and sleeve 64 upward toward the uphole end 54.

Figure 2E:
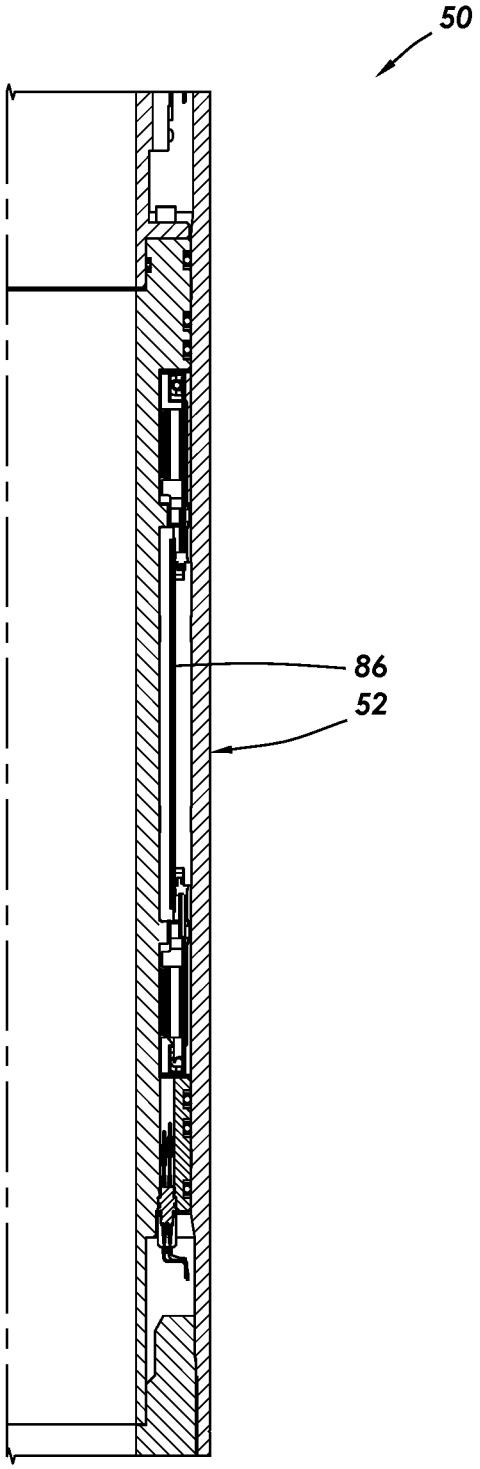
Figure 2F:
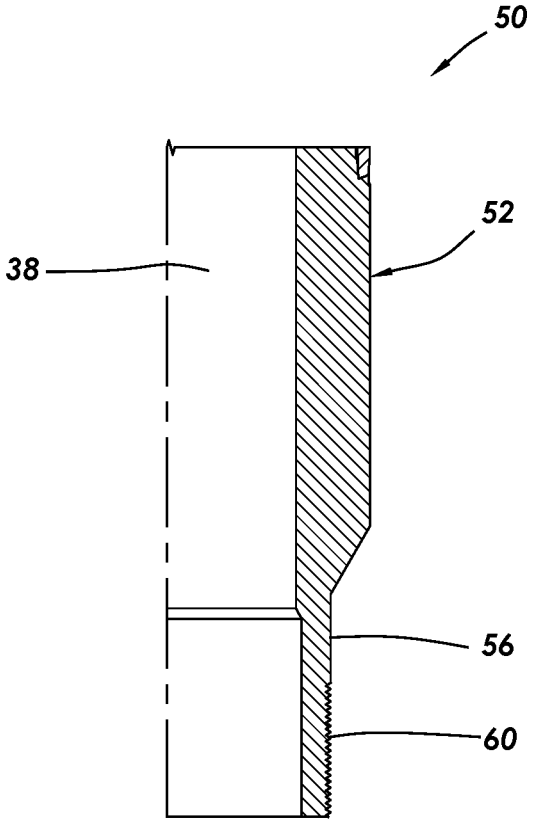

Operation of the pump 82 and control valve 84 are controlled by an electronic circuit 86 (see FIG. 2E). The electronic circuit 86 operates the pump 82 and control valve 84 in response to outputs of an antenna 88 and a pressure transducer or other type of pressure sensor 90 (see FIG. 2A).

In this example, the antenna 88 encircles the flow passage 38 and is pressure balanced between its interior and its exterior by means of a fluid-filled annular chamber 92 in communication with the flow passage 38. A floating annular piston 94 is reciprocably and sealingly received in the chamber 92. The pressure sensor 90 is exposed to a lower portion of the chamber 92 filled with clean fluid. Thus, the pressure sensor 90 can detect pressure signals in the flow passage 38 via the chamber 92 and piston 94.

The antenna 88 can receive radio frequency signals 100 emitted by a transmitter 96 of an RFID tag 98 in the flow passage 38. The RFID tag 98 can be deployed into the flow passage 38 and displaced through the valve assembly 50 when it is desired to actuate the valve assembly between its open and closed configurations.

In this example, the radio frequency signals 100 emitted by the transmitter 96 of the RFID tag 98 can be detected by the antenna 88 and communicated to the electronic circuit 86. In response, the electronic circuit 86 can cause the pump 82 to apply increased pressure to the control line 80 via the control valve 84.

When sufficient pressure has been applied via the control line 80 to the bore 76 above the piston 72, the piston and sleeve 64 will displace in a downhole direction, thereby compressing the spring 74 and allowing the closure member 62 to pivot in a downhole direction. The closure member 62 will engage the seat 70 and thereby prevent downward flow through the flow passage 38.

Increased pressure can then be applied to the flow passage 38 (e.g., using a pump at the surface), in order to test the pressure integrity of the tubing string 22 above the tester valve assembly 50. Note that, in the valve assembly 50 itself, this increased pressure is only applied above or uphole of the closure member 62. The various components of the valve assembly 50 downhole of the closure member 62 are not exposed to the increased pressure. Thus, the housing assembly 52, pump 82, control valve 84, etc., downhole of the closure member 62 do not have to be configured to withstand the increased pressure applied during the test of the tubing string 22 above the valve assembly 50.

The antenna 88 is exposed to the pressure in the flow passage 38 above the closure member 62, but the antenna is pressure balanced, so it does not have to withstand a high absolute pressure differential due to the pressure integrity test. The pressure sensor 90 is also exposed to the pressure in the flow passage 38 above the closure member 62, but it is configured to withstand and sense such high absolute pressure differentials.

Figure 3A:
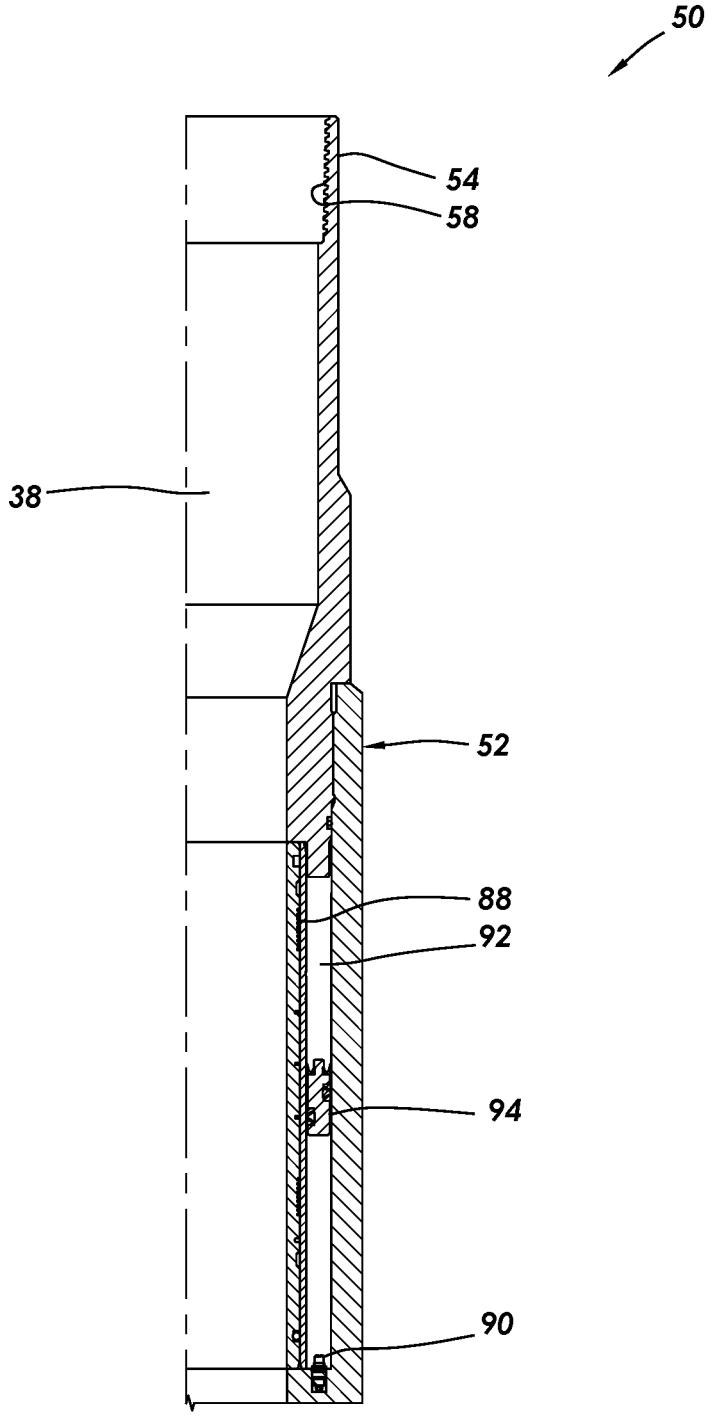
FIGS. 3A-C are representative cross-sectional views of successive axial sections of the valve assembly in a closed configuration.
Figure 3B:
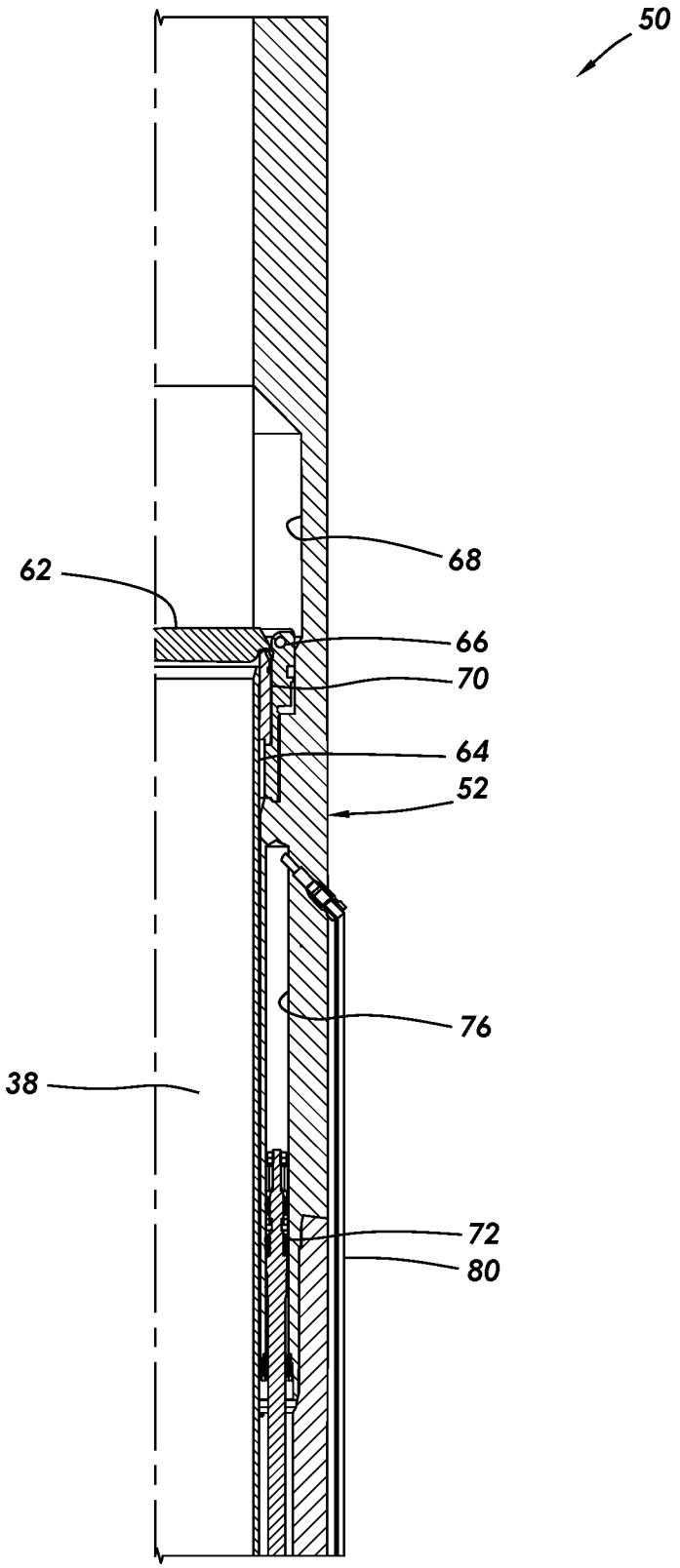
Figure 3C:
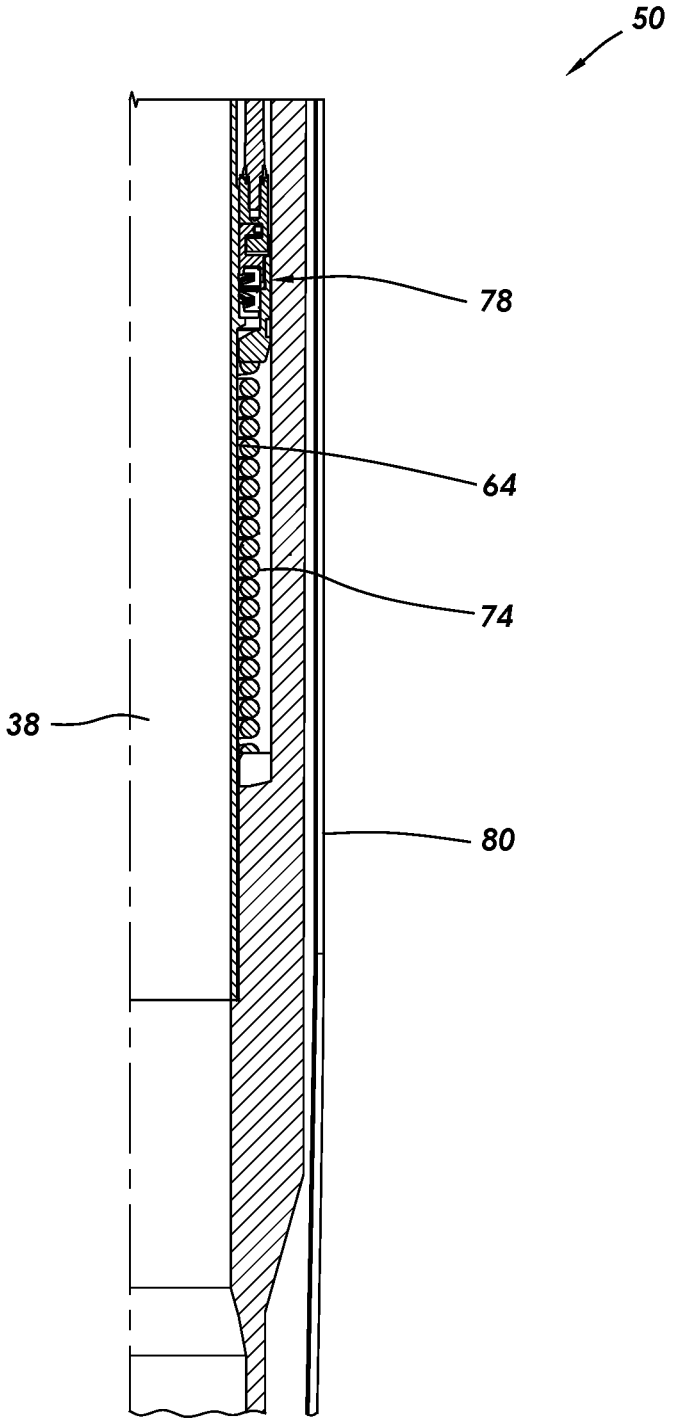

Referring additionally now to FIGS. 3A-C, an upper portion of the valve assembly 50 is representatively illustrated in a closed configuration. In this configuration, flow through the flow passage 38 is prevented.

Note that the piston 72 and sleeve 64 are displaced in the downhole direction, as compared to the open configuration of FIGS. 2A-F. The spring 74 is further compressed. The closure member 62 is pivoted downward in the downhole direction, so that it now sealingly engages the seat 70.

Once the valve assembly 50 has been operated to this closed configuration, the electronic circuit 86 will cease operation of the pump 82 and will close the control valve 84, so that the increased pressure applied to the bore 76 above the piston 72 will be maintained. If, however, this increased pressure cannot be maintained (e.g., due to a seal failure, control line 80 leakage, failure of the electronic circuit 86, pump 82 or control valve 84, etc.), the spring 74 will upwardly displace the piston 72 and sleeve 64, so that the closure member 62 will be pivoted in the uphole direction by the sleeve, and flow will again be permitted through the flow passage 38. Thus, the valve assembly 50 is configured to be "fail-open," in that it will resume or maintain its open configuration in the event of an operational failure.

In normal operation, when the tubing string 22 pressure integrity test has been concluded, the valve assembly 50 can be operated to its open configuration by applying an appropriate pressure signal to the flow passage 38. The pressure in the tubing string 22 may be reduced at the conclusion of the pressure integrity test and prior to transmitting the pressure signal. The pressure signal could be in the form of a series of pressure pulses, predetermined pressure levels applied for predetermined time periods, etc. The scope of this disclosure is not limited to use of any particular type of pressure signal.

The pressure signal is detected by the pressure sensor 90 and is communicated to the electronic circuit 86. In response, the electronic circuit 86 causes the control valve 84 to vent the increased pressure applied via the control line 80 to the bore 76 above the piston 72. The spring 74 can then upwardly displace the piston 72 and sleeve 64, so that the closure member 62 is pivoted in the uphole direction by the sleeve, and flow will again be permitted through the flow passage 38.

Figure 4:
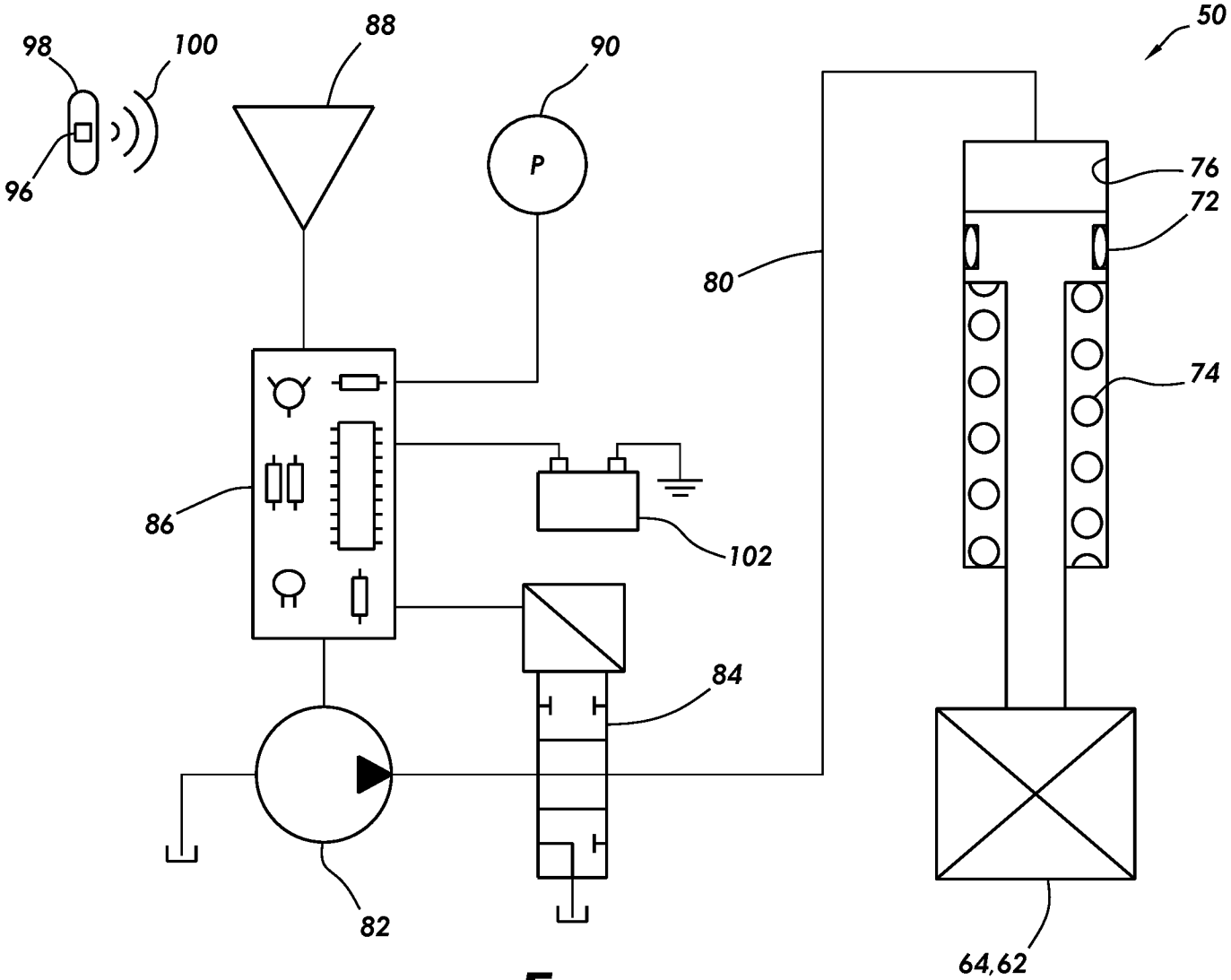
FIG. 4 is a representative schematic view of the valve assembly.

Referring additionally now to FIG. 4, a simplified schematic of the valve assembly 50 is representatively illustrated. In this schematic, it may be seen that the electronic circuit 86 is connected to each of the pump 82, control valve 84, antenna 88 and pressure sensor 90. A battery 102 can be used to supply electrical power to the electronic circuit 86 and other components of the valve assembly 50.

As mentioned above, the electronic circuit 86 controls operation of the pump 82 and control valve 84 to either apply increased pressure to the control line 80 and the bore 76 above the piston 72 (so that the piston 72 and sleeve 64 are displaced downward to their closed position), maintain this increased pressure in the control line and bore above the piston, or vent this increased pressure (so that the piston 72 and sleeve 64 can be displaced upward to their open position).

The electronic circuit 86 operates the pump 82 and control valve 84 to apply the increased pressure in response to receipt of the radio frequency signal 100 by the antenna 88. The electronic circuit 86 operates the control valve 84 to vent the increased pressure in response to receipt of an appropriate pressure signal by the pressure sensor 90.

It may now be fully appreciated that the above disclosure provides to the art significant advancements to the arts of constructing and operating valves for use in testing a pressure integrity of a tubing string in a well. In one example described above, the valve assembly 50 is configured so that various components (such as, the pump 82, control valve 84, electronic circuit 86, etc.) and portions of a housing assembly enclosing these components are not subjected to high absolute pressure differentials due to a tubing string pressure integrity test.

The above disclosure provides to the art a valve assembly 50 for use in a subterranean well. In one example, the valve assembly 50 can include a flow passage 38 extending between an uphole end 54 and a downhole end 56 of the valve assembly 50, a flapper (e.g., closure member 62) that pivots between an open position and a closed position to thereby respectively permit and prevent flow through the flow passage 38, and the flapper pivots toward the downhole end 56 from the open position to the closed position, and a pump 82 operable to pivot the flapper, the pump 82 being positioned between the flapper and the downhole end 56.

The fluid pressure developed by the pump 82 may cause the flapper to pivot from the open position to the closed position.

The valve assembly 50 may include an antenna 88 positioned opposite the pump 82 from the flapper. The antenna 88 may receive a radio frequency transmission from a transmitter 96 in the flow passage 38. Operation of the pump 82 may be controlled by an electronic circuit 86, and the electronic circuit 86 may be positioned opposite the flapper from the antenna 88.

A sleeve 64 may be reciprocably received in a housing (e.g., housing assembly 52) of the valve assembly 50. The flow passage 38 may extend through the sleeve 64. Displacement of the sleeve 64 toward the uphole end 54 may pivot the flapper to its open position, and displacement of the sleeve 64 toward the downhole end 56 may permit the flapper to pivot to its closed position.

A spring 74 may bias the sleeve 64 toward the uphole end 54. A piston 72 may be connected to the sleeve 64. The piston 72 may displace toward the downhole end 56 in response to fluid pressure applied from the pump 82 to the piston 72.

A pressure sensor 90 may sense pressure in the flow passage 38 between the flapper and the uphole end 54. The pressure sensor 90 may be positioned opposite the flapper from the pump 82.

A method of testing a completion tubing string 22 in a subterranean well is also provided to the art by the above disclosure. In one example, the method can include the following steps: connecting a valve assembly 50 in the completion tubing string 22 so that an internal flow passage 38 of the completion tubing string 22 extends through the valve assembly 50; displacing a radio frequency identification tag 98 through the valve assembly 50, thereby causing a closure member 62 of the valve assembly 50 to displace to a closed position in which flow through the flow passage 38 is prevented; increasing pressure in the completion tubing string 22 while the closure member 62 is in the closed position, thereby testing a pressure integrity of the completion tubing string 22 on an uphole side of the closure member 62; and transmitting a pressure signal via the flow passage 38 to a pressure sensor 90 of the valve assembly 50, thereby causing the closure member 62 to displace to an open position in which flow through the flow passage 38 is permitted, the pressure sensor 90 being connected to an electronic circuit 86 positioned on a downhole side of the closure member 62.

The pressure in the completion tubing string 22 may be reduced after the pressure increasing step and prior to the pressure signal transmitting step.

The closure member 62 may displace to the closed position in response to a pump 82 applying an increased pressure to a piston 72. The pump 82 may be positioned on the downhole side of the closure member 62.

The piston 72 may displace toward a downhole end of the valve assembly 50 when the closure member 62 displaces toward the closed position. The pressure signal transmitting step may cause the application of the increased pressure to the piston 72 to cease, thereby permitting the piston 72 to displace toward an uphole end of the valve assembly 50.

The closure member 62 may comprise a flapper. The flapper may pivot toward a downhole end of the valve assembly 50 when the flapper displaces to the closed position.

A radio frequency signal 100 may be transmitted from the radio frequency identification tag 98 to an antenna 88 of the valve assembly 50. The antenna 88 may be positioned on the uphole side of the closure member 62. The antenna 88 may be positioned opposite the closure member 62 from the electronic circuit 86.

The pressure sensor 90 may be positioned on the uphole side of the closure member 62. The pressure sensor 90 may be positioned opposite the closure member 62 from the electronic circuit 86.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A valve assembly for use in a subterranean well, the valve assembly comprising:

a flow passage extending between an uphole end and a downhole end of the valve assembly;

a flapper that pivots between an open position and a closed position to thereby respectively permit and prevent flow through the flow passage, and the flapper pivots toward the downhole end from the open position to the closed position; and a pump operable to pivot the flapper to the closed position, the pump being positioned between the flapper and the downhole end.

2. The valve assembly of claim 1, in which fluid pressure developed by the pump causes the flapper to pivot from the open position to the closed position.

3. The valve assembly of claim 1, further comprising an antenna positioned opposite the pump from the flapper.

4. The valve assembly of claim 3, in which the antenna receives a radio frequency transmission from a transmitter in the flow passage.

5. The valve assembly of claim 3, in which operation of the pump is controlled by an electronic circuit, and the electronic circuit is positioned opposite the flapper from the antenna.

6. The valve assembly of claim 1, in which a sleeve is reciprocably received in a housing of the valve assembly, the flow passage extends through the sleeve, displacement of the sleeve toward the uphole end pivots the flapper to its open position, and displacement of the sleeve toward the downhole end permits the flapper to pivot to its closed position.

7. The valve assembly of claim 6, in which a spring biases the sleeve toward the uphole end.

8. The valve assembly of claim 6, in which a piston is connected to the sleeve, and the piston displaces toward the downhole end in response to fluid pressure applied from the pump to the piston.

9. The valve assembly of claim 1, in which a pressure sensor senses pressure in the flow passage between the flapper and the uphole end.

10. The valve assembly of claim 9, in which the pressure sensor is positioned opposite the flapper from the pump.

11. A method of testing a completion tubing string in a subterranean well, the method comprising:

connecting a valve assembly in the completion tubing string so that an internal flow passage of the completion tubing string extends through the valve assembly;

displacing a radio frequency identification tag through the valve assembly, thereby causing a closure member of the valve assembly to displace to a closed position in which flow through the flow passage is prevented, in which the closure member displaces to the closed position in response to a pump applying an increased pressure to a piston, and in which the pump is positioned on a downhole side of the closure member;

increasing pressure in the completion tubing string while the closure member is in the closed position, thereby testing a pressure integrity of the completion tubing string on an uphole side of the closure member; and transmitting a pressure signal via the flow passage to a pressure sensor of the valve assembly, thereby causing the closure member to displace to an open position in which flow through the flow passage is permitted, the pressure sensor being connected to an electronic circuit positioned on the downhole side of the closure member.

12. The method of claim 11, in which the piston displaces toward a downhole end of the valve assembly when the closure member displaces toward the closed position.

13. The method of claim 11, in which the pressure signal transmitting causes the application of the increased pressure to the piston to cease, thereby permitting the piston to displace toward an uphole end of the valve assembly.

14. The method of claim 11, in which the closure member comprises a flapper, and the flapper pivots toward a downhole end of the valve assembly when the flapper displaces to the closed position.

15. The method of claim 11, in which a radio frequency signal is transmitted from the radio frequency identification tag to an antenna of the valve assembly, and the antenna is positioned on the uphole side of the closure member.

16. The method of claim 15, in which the antenna is positioned opposite the closure member from the electronic circuit.

17. The method of claim 11, in which the pressure sensor is positioned on the uphole side of the closure member.

18. The method of claim 11, in which the pressure sensor is positioned opposite the closure member from the electronic circuit.

* * * * *